US009447956B2

(12) United States Patent
Kim et al.

(10) Patent No.: US 9,447,956 B2
(45) Date of Patent: Sep. 20, 2016

(54) LIGHT EMITTING DEVICE

(71) Applicant: SAMSUNG ELECTRONICS CO., LTD., Suwon-si, Gyeonggi-do (KR)

(72) Inventors: Dong Wook Kim, Suwon-si (KR); Back Ki Sung, Suwon-si (KR)

(73) Assignee: SAMSUNG ELECTRONICS CO., LTD., Suwon-Si, Gyeonggi-Do (KR)

( * ) Notice: Subject to any disclaimer, the term of this patent is extended or adjusted under 35 U.S.C. 154(b) by 12 days.

(21) Appl. No.: 14/070,455

(22) Filed: Nov. 1, 2013

(65) Prior Publication Data

US 2014/0119016 A1 May 1, 2014

(30) Foreign Application Priority Data

Nov. 1, 2012 (KR) ..... 10-2012-0122824

(51) Int. Cl.

| | |
|---|---|
| ***F21S 4/00*** | (2006.01) |
| ***F21V 29/00*** | (2015.01) |
| ***F21K 99/00*** | (2016.01) |
| ***F21V 29/83*** | (2015.01) |
| *F21Y 111/00* | (2016.01) |
| *F21Y 101/02* | (2006.01) |

(52) U.S. Cl.

CPC ..... *F21V 29/22* (2013.01); *F21K 9/135* (2013.01); *F21V 29/83* (2015.01); *F21Y 2101/02* (2013.01); *F21Y 2111/007* (2013.01)

(58) Field of Classification Search

CPC ..... F21V 21/00; F21V 29/22
USPC ..... 362/249.01, 249.02, 249.06, 249.14
See application file for complete search history.

(56) References Cited

U.S. PATENT DOCUMENTS

| | | | | |
|---|---|---|---|---|
| 6,465,961 | B1 * | 10/2002 | Cao | 315/58 |
| 7,513,653 | B1 * | 4/2009 | Liu et al. | 362/294 |

FOREIGN PATENT DOCUMENTS

| | | | |
|---|---|---|---|
| JP | 11-260119 | A | 9/1999 |
| JP | 2010-287343 | A | 12/2010 |
| KR | 10-2010-0089371 | A | 8/2010 |
| KR | 10-2011-0101789 | A | 9/2011 |
| WO | 2010/096498 | A1 | 8/2010 |

* cited by examiner

*Primary Examiner* — Evan Dzierzynski
*Assistant Examiner* — Meghan Ulanday

(57) ABSTRACT

A light emitting device includes at least one light emitting unit configured to emit light, a body unit supporting the at least one light emitting unit, and a support unit disposed on the body unit defining a light emitting position of the at least one light emitting unit. The support unit has a conical shape and is configured to support the at least one light emitting unit.

12 Claims, 3 Drawing Sheets

LIGHT EMITTING DEVICE

CROSS-REFERENCE TO RELATED APPLICATION

This application claims benefit of priority to Korean Patent Application No. 10-2012-0122824 filed on Nov. 1, 2012, with the Korean Intellectual Property Office, the entire contents of which are hereby incorporated by reference.

TECHNICAL FIELD

The present inventive concept relates to a light emitting device, and more particularly, to a light emitting device increasing light emission efficiency by suppressing generation of a dead zone by increasing a beam angle of light.

BACKGROUND

With recent development of a semiconductor technology, use of a high-efficiency light emitting diode (LED) is spreading. The LED is being applied to various fields of light emitting devices, such as a backlight unit of a display device, an incandescent lamp, a fluorescent lamp, and a street lamp.

In a light emitting device such as a lamp including the LED, a dead zone in which light may not reach may be generated according to a beam angle of the light. The dead zone of light may directly affect light emission quality. Accordingly, there has been a steady demand for research to prevent generation of the dead zone of light.

SUMMARY

An aspect of the present inventive concept provides a light emitting device preventing generation of a dead zone of light by increasing a beam angle of light.

One aspect of the present inventive concept relates to a light emitting device including at least one light emitting unit configured to emit light, a body unit supporting the at least one light emitting unit, and a support unit disposed on the body unit defining a light emitting position of the at least one light emitting unit. The support unit has a conical shape and is configured to support the at least one light emitting unit.

The supporting unit may be disposed on an upper end of the body unit and may include a plurality of mounting surfaces on which the at least one light emitting unit is disposed.

The supporting unit may include a plurality of mounting surfaces protruding from one side of the body unit, and the at least one light emitting unit may be disposed on the plurality of mounting surfaces.

The support unit may include a support body protruding from one side of the body unit, a plurality of mounting surfaces inclined with respect to the support body such that the at least one light emitting unit is disposed on the plurality of mounting surfaces, and at least one air vent hole defined through the support body.

The support unit may include a heat radiating material to radiate heat of the at least one light emitting unit.

Another aspect of the present inventive concept encompasses a light emitting device including at least one light emitting unit configured to emit light, a body unit supporting the at least one light emitting unit, and a heat radiation unit supporting the at least one light emitting unit and configured to radiate heat of the at least one light emitting unit. The heat radiation unit has a conical shape and supports the at least one light emitting unit in an inclined position and is disposed on the body unit.

The radiation unit may protrude from the body unit and may include at least one mounting surface on which the at least one light emitting unit is to be disposed.

The heat radiation unit may include a heat radiation body protruding from one side of the body unit; a plurality of mounting surfaces inclined with respect to the heat radiation body such that the at least one light emitting unit is disposed thereon; and at least one air vent hole defined through the heat radiation body.

Still another aspect of the present inventive concept relates to a light emitting device including at least one light emitting unit configured to emit light, a body unit supporting the at least one light emitting unit, and a support unit protruding from an upper surface of the body unit and having an inclined surface with respect to the upper surface of the body unit, such that the at least one light emitting unit is disposed on the inclined surface.

The support unit may have a plurality of inclined surfaces defining a pyramid shape.

The support unit may have a conical shape to support the at least one light emitting unit in an inclined position.

According to aspects of the present inventive concept, a light emitting device supports at least one light emitting unit in an inclined position. Therefore, a beam angle of light may be increased.

Additionally, according to other aspects of the present inventive concept, since the beam angle of light is improved in reduction of dead zones, light emission performance may be secured even with a reduced number of light emitting units. Accordingly, material cost may be reduced.

Furthermore, the beam angle of light and heat radiation performance of the light emitting units may be secured simultaneously, thereby increasing economic efficiency.

BRIEF DESCRIPTION OF THE DRAWINGS

These and/or other aspects, features, and advantages of the present inventive concept will become apparent and more readily appreciated from the following description of exemplary embodiments, taken in conjunction with the accompanying drawings in which like reference characters may refer to the same or similar parts throughout the different views. The drawings are not necessarily to scale, emphasis instead being placed upon illustrating the principles of the embodiments of the present inventive concept. In the drawings, the thickness of layers and regions may be exaggerated for clarity.

DETAILED DESCRIPTION

Figure 1:
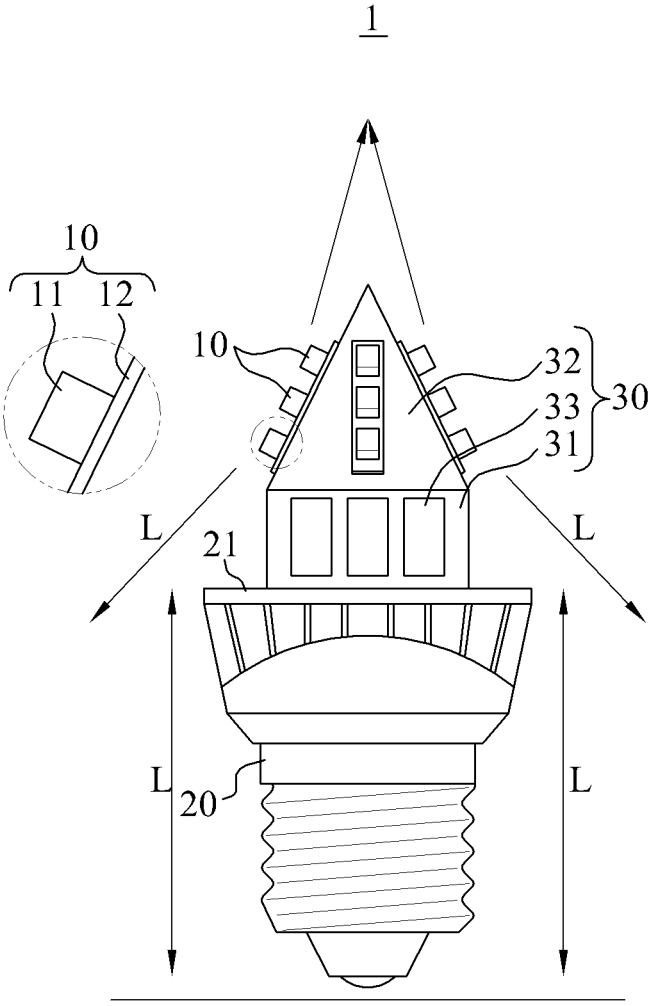
FIG. 1 is a side view illustrating a light emitting device according to an embodiment of the present inventive concept.

Reference will now be made in detail to exemplary embodiments of the present inventive concept, examples of which are illustrated in the accompanying drawings, wherein like reference numerals refer to the like elements throughout. However, the present inventive concept is not limited to the embodiments.

Figure 2:
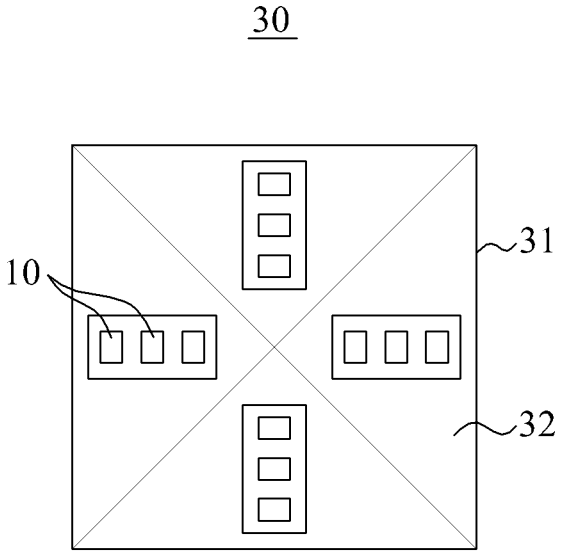
FIG. 2 is a plan view illustrating the light emitting device of FIG. 1.
Figure 3A:
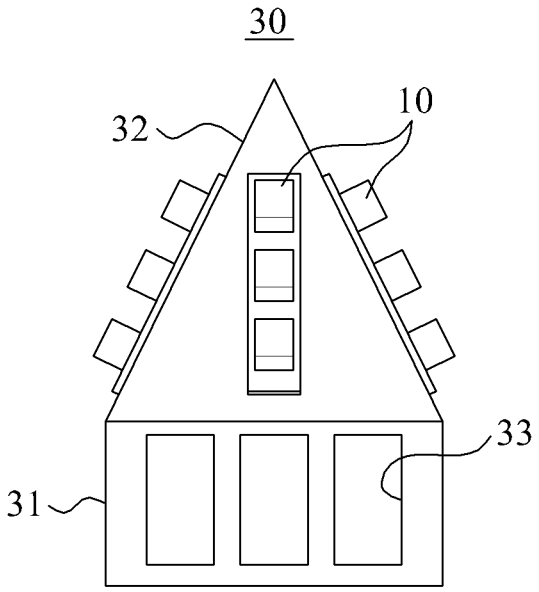
FIGS. 3A and 3B are diagrams illustrating a heat radiation unit of the light emitting device of FIG. 1.
Figure 3B:
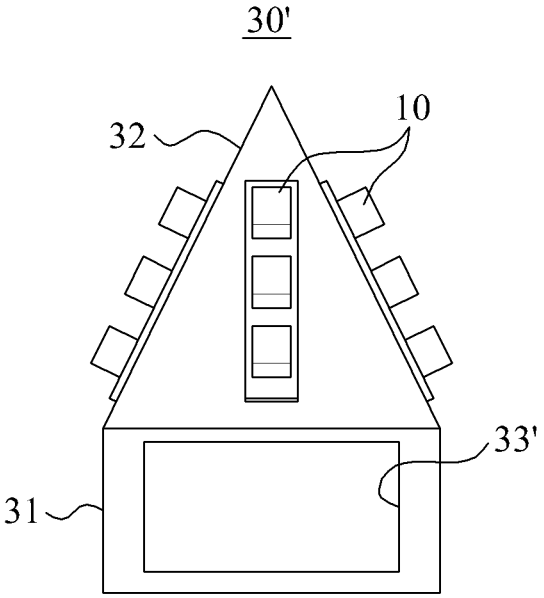

FIG. 1 is a side view illustrating a light emitting device 1 according to an embodiment of the present inventive concept. FIG. 2 is a plan view illustrating the light emitting device of FIG. 1. FIGS. 3A and 3B are diagrams illustrating the heat radiation unit of the light emitting device of FIG. 1. Referring to FIG. 1, the light emitting device 1 includes a light emitting unit 10, a body unit 20, and a support unit 30.

The light emitting unit 10 may serve as a light source of the light emitting device 1 configured to light up by emitting light. As shown in an enlarged view of FIG. 1, the light emitting unit 10 may include a light emitting diode (LED) 11 configured to emit light and a control substrate 12 configured to electrically control the LED 11. The LED 11 may be packaged by a generally-known semiconductor manufacturing method which will not be described in detail.

At least one light emitting unit 10 may be provided. As shown in FIG. 1, a plurality of the light emitting units 10 may be arranged in multiple parallel arrays to increase luminosity. A number, arrangement, and shape of the light emitting units 10 are not limited to the embodiment of FIG. 1.

The body unit 20 may support the light emitting unit 10. The body unit 20 may be threaded to engage with a socket for electrical connection. For example, when the light emitting device 1 includes a lamp, the body unit 20 may serve as a body of the lamp. The support unit 30 may be provided to the body unit 20 to support a lighting position of the light emitting unit 10. The support unit 30 may be mounted to an upper end 21 of the body unit 20 and may be in a conical shape. The support unit 30 may support the light emitting unit 10, such that a beam angle of light L (indicated by arrows in FIG. 1) increases up to, for example, approximately 200° For this purpose, the support unit 30 may include a support body 31, a mounting surface 32, and an air vent hole 33.

The support body 31 may protrude from one side of the body unit 20, that is, from the upper end 21 of the body unit 20. The support body 31 may be in the shape of a rectangular column including a hollow. The shape of the support body 31 may be varied to be a polygonal column or a circular column or a cylindrical column.

The mounting surface 32 may be provided in a plural number. A plurality of the mounting surfaces 32 may integrally extend from the support body 31 to be inclined with respect to the support body 31, so as to mount the at least one light emitting unit 10 on the mounting surfaces 32. When the support body 31 has rectangular column shape, the mounting surfaces 32 may extend from edges of an upper end of the support body 31, being inclined at angles with respect to the upper end 21 of the body unit 20. In detail, as shown in FIG. 2, the mounting surfaces 32 may include four triangle shapes. Each of the mounting surfaces 32 may include three light emitting units 10 linearly arranged. As the four mounting surfaces 32 having the triangle shapes are interconnected, a pyramid shape may be formed. The shape of the mounting surfaces 32 is not limited to the illustrated embodiment. Various other shapes such as a circular cone or a polygonal cone may be applied according to the shape of the support body 31.

At least one air vent hole 33 may be formed through the support body 31. As air circulates through the air vent hole 33, heat radiation efficiency of the light emitting unit 10 mounted to the mounting surfaces 32 may be increased. As shown in FIG. 3A, a plurality of air vent holes 33 may be formed parallel on each side of the support body 31. However, as shown in a modified example of FIG. 3B, a single air vent hole 33' may be formed on each side of the support body 31.

The support body 31 and the mounting surfaces 32 may be made of a heat radiating material capable of radiating heat during light emission of the light emitting unit 10. That is, the supporting unit 30 may be a heat sink having a heat radiation function. Accordingly, the supporting unit 30 may have a double effect of an increased beam angle of the light L of the light emitting unit 10 and heat radiation.

A light emitting operation of the light emitting device 1 will be described with reference to FIG. 1.

The light emitting unit 10 may be mounted to the mounting surfaces 32 and emit light in this state. Here, the light emitting unit 10 emits light by being provided with power through the body unit 20. When the mounting surfaces 32 form a conical shape or a pyramid shape, the light L may reach the body unit 20 with the beam angle of approximately 200° or more. Accordingly, generation of a dead zone of the light L emitted from the at least one light emitting unit 10 may be prevented.

Although a few exemplary embodiments of the present inventive concept have been shown and described, the present inventive concept is not limited to the described exemplary embodiments. Instead, it would be appreciated by those skilled in the art that changes may be made to these exemplary embodiments without departing from the principles and spirit of the inventive concept, the scope of which is defined by the claims and their equivalents.

What is claimed is:

1. A light emitting device, comprising:

at least one light emitting unit configured to emit light;

a body unit supporting the at least one light emitting unit; and a support unit disposed on the body unit defining a light emitting position of the at least one light emitting unit, wherein the support unit includes a support body having a column shape, and a mounting body having a conical shape and configured to support the at least one light emitting unit, wherein the support body has a plurality of surfaces each having a plurality of air vent holes extending through the support body and disposed so as to be parallel to each other, wherein the support body protrudes from one side of the body unit, wherein the mounting body includes a plurality of mounting surfaces inclined with respect to the support body such that the at least one light emitting unit is disposed on the plurality of mounting surfaces, and wherein the plurality of air vent holes extending through the support body are disposed on surfaces of the support body that are directly adjacent to the inclined mounting surfaces having the at least one light emitting unit disposed thereon.

2. The light emitting device of claim 1, wherein the support unit is disposed on an upper end of the body unit.

3. The light emitting device of claim 1, wherein:

the plurality of mounting surfaces of the mounting body of the support unit protrude from one side of the body unit.

4. The light emitting device of claim 1, wherein the support unit comprises a heat radiating material to radiate heat of the at least one light emitting unit.

5. The light emitting device of claim 1, wherein no light emitting units are disposed on the support body.

6. A light emitting device, comprising:

at least one light emitting unit configured to emit light;

a body unit supporting the at least one light emitting unit; and a heat radiation unit supporting the at least one light emitting unit and configured to radiate heat of the at least one light emitting unit, wherein the heat radiation unit includes a heat radiation body having a column shape and disposed on the body unit, and a mounting body having a conical shape, supporting the at least one light emitting unit in an inclined position, and disposed on the heat radiation body, wherein the heat radiation body has a plurality of surfaces each having a plurality of air vent holes extending through the heat radiation body and disposed so as to be parallel to each other, wherein the heat radiation body protrudes from one side of the body unit, wherein the mounting body includes a plurality of mounting surfaces inclined with respect to the heat radiation body such that the at least one light emitting unit is disposed thereon, and wherein the plurality of air vent holes extending through the heat radiation body are disposed on surfaces of the heat radiation body that are directly adjacent to the inclined mounting surfaces having the at least one light emitting unit disposed thereon.

7. The light emitting device of claim 6, wherein no light emitting units are disposed on the heat radiation body.

8. A light emitting device, comprising:

at least one light emitting unit configured to emit light;

a body unit supporting the at least one light emitting unit; and a support unit including a support body having a column shape protruding from an upper surface of the body unit, and a mounting body protruding from the support body and having a plurality of inclined surfaces inclined with respect to the upper surface of the body unit and with respect to the support body, such that the at least one light emitting unit is disposed on the plurality of inclined surfaces, wherein the support body has a plurality of surfaces each having a plurality of air vent holes extending through the support body and disposed so as to be parallel to each other, wherein the plurality of air vent holes extending through the support body are disposed on surfaces of the support body that are directly adjacent to the inclined surfaces having the at least one light emitting unit disposed thereon.

9. The light emitting device of claim 8, wherein the plurality of inclined surfaces of the mounting body of the support unit define a pyramid shape.

10. The light emitting device of claim 8, wherein the mounting body of the support unit has a conical shape and supports the at least one light emitting unit in an inclined position.

11. The light emitting device of claim 8, wherein no light emitting units are disposed on the support body.

12. The light emitting device of claim 8, wherein the plurality of air vent holes extending through the support body are disposed on surfaces of the support body that are directly adjacent to the inclined mounting surface having the at least one light emitting unit disposed thereon.

* * * * *